US010287837B2

(12) United States Patent
Carrillo

(10) Patent No.: US 10,287,837 B2
(45) Date of Patent: May 14, 2019

(54) HYDRAULIC TIMING DEVICE

(71) Applicant: Cameron International Corporation, Houston, TX (US)

(72) Inventor: Kody Carrillo, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 212 days.

(21) Appl. No.: 15/226,015

(22) Filed: Aug. 2, 2016

(65) Prior Publication Data

US 2018/0038390 A1 Feb. 8, 2018

(51) Int. Cl.

| | |
|---|---|
| ***F15B 21/10*** | (2006.01) |
| ***E21B 33/035*** | (2006.01) |
| *F15B 1/027* | (2006.01) |

(52) U.S. Cl.

CPC ..... *E21B 33/0355* (2013.01); *F15B 21/10* (2013.01); *F15B 1/027* (2013.01); *F15B 2201/31* (2013.01); *F15B 2211/20561* (2013.01)

(58) Field of Classification Search

CPC ..... F15B 21/10; F15B 2201/31; E21B 33/062

See application file for complete search history.

(56) References Cited

U.S. PATENT DOCUMENTS

| | | | | |
|---|---|---|---|---|
| 3,042,121 | A * | 7/1962 | Broetzman | A01B 63/06 172/239 |
| 3,905,279 | A * | 9/1975 | Yadon | F15B 13/01 92/110 |
| 4,821,624 | A * | 4/1989 | Smith | F15B 15/24 91/401 |
| 6,679,054 | B2 * | 1/2004 | Doveri | B62H 1/02 280/301 |

* cited by examiner

*Primary Examiner* — F Daniel Lopez

(74) *Attorney, Agent, or Firm* — Helene Raybaud

(57) ABSTRACT

A pressure vessel having an adjustable volume to adjust a hydraulic time delay produced by the pressure vessel. The pressure vessel can include a piston with an adjustable stroke and a rod received in a housing to limit the stroke of the piston. The piston divides the housing into a pressure cavity and a reset cavity. Spacers can be removably coupled to the rod to limit the stroke of the piston. Optionally, a brake wall can be positioned to obstruct the path of the rod to limit the stroke of the piston.

17 Claims, 3 Drawing Sheets

HYDRAULIC TIMING DEVICE

BACKGROUND

This section is intended to provide background information to facilitate a better understanding of the various aspects of the described embodiments. Accordingly, it should be understood that these statements are to be read in this light and not as admissions of prior art.

In some offshore drilling operations, a wellhead at the sea floor is positioned at the upper end of the subterranean wellbore lined with casing; a blowout preventer (BOP) stack is mounted to the wellhead; and a lower marine riser package (LMRP) is mounted to the BOP stack. The upper end of the LMRP may include a flex joint coupled to the lower end of a drilling riser that extends upward to a drilling vessel at the sea surface. A drill string is hung from the drilling vessel through the drilling riser, the LMRP, the BOP stack, and the wellhead into the wellbore.

During drilling operations, drilling fluid, or mud, is pumped from the sea surface down the drill string, and returns up the annulus around the drill string. In the event of a rapid invasion of formation fluid into the annulus, commonly known as a "kick", the BOP stack and/or LMRP may actuate to help seal the annulus and control the fluid pressure in the wellbore. In particular, the BOP stack and LMRP include closure members, or cavities, designed to help seal the wellbore and prevent the release of high-pressure formation fluids from the wellbore. Thus, the BOP stack and LMRP function as pressure control devices.

Pressure accumulators provide a pressurized working fluid for the control and operation of subsea equipment, such as the BOP stack. In particular, pressure accumulators are used to set the hydraulic timing in triggering the various BOPs in the BOP stack to seal the wellbore, especially in a deadman trigger sequence when the drilling riser is removed from the BOP stack. However, pressure accumulators have fixed volumes, which controls the minimum time delay produced by the accumulator. In particular, this minimum time delay can be affected by various factors, such as ambient temperature, hydrostatic pressure, as well as factors related to hoses, tubing, valves, or other hydraulic devices in communication with the accumulator (e.g., movement, crimps, clogging), etc. These factors can even arise after the accumulators are deployed at a subsea location. One approach to adjust the time delay of a pressure accumulator is to reduce the flow rate of fluid into it using a flow control valve. Thus, the time delay produced by the accumulator can be increased, but not decreased. However, fine adjustment of flow rate is a challenge with flow control valves.

BRIEF DESCRIPTION OF THE DRAWINGS

For a detailed description of the embodiments of the invention, reference will now be made to the accompanying drawings in which.

DETAILED DESCRIPTION

This disclosure provides a pressure vessel having an adjustable volume. Specifically, the disclosure provides a pressure vessel including a piston and rod received in a housing with an adjustable stroke.

A pressure vessel can have an adjustable volume to finely increase or decrease a time delay of an actuator operating a subsea component such as a subsea BOP. As an example, the pressure vessel can include a piston within a housing with an adjustable stroke. The pressure vessel allows pressurized fluid to fill a hydraulic pressure cavity by stroking the piston until the piston is mechanically stopped. The stroke of the piston is adjustable by selecting spacers attached to a rod coupled to the piston or positioning a brake wall to limit the stroke. For example, adjusting the stroke of the piston, which in turn adjusts the volume of the pressure vessel, may result in adjusting the time delay produced by the pressure vessel by at least one second.

Figure 1A:
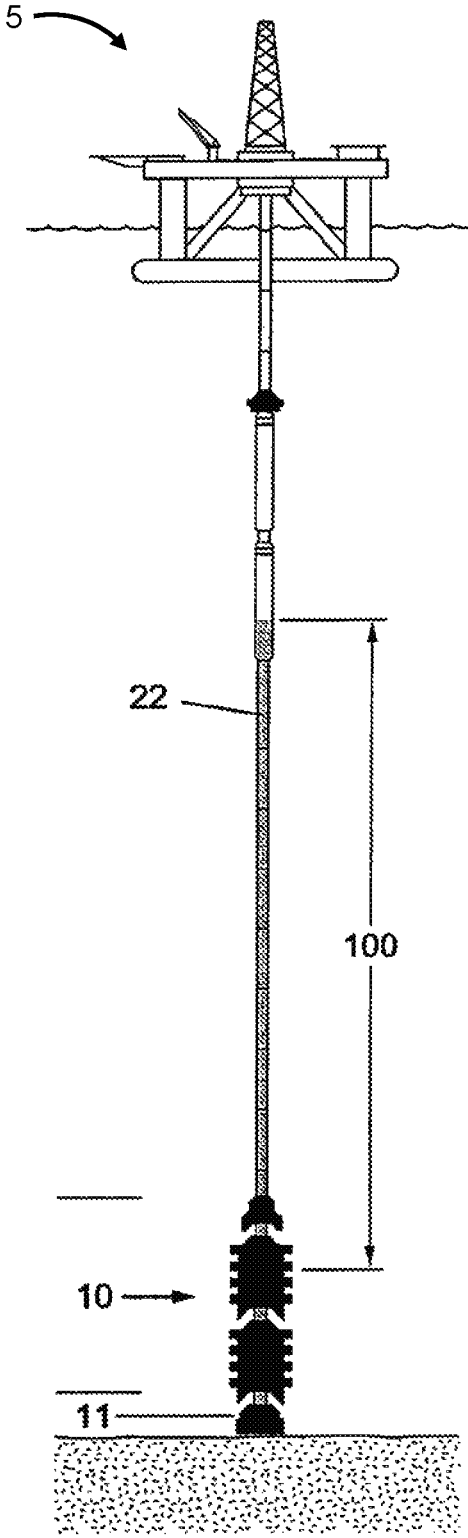
FIGS. 1*a* and *b* depict a subsea drilling system, according to one or more embodiments.
Figure 1B:
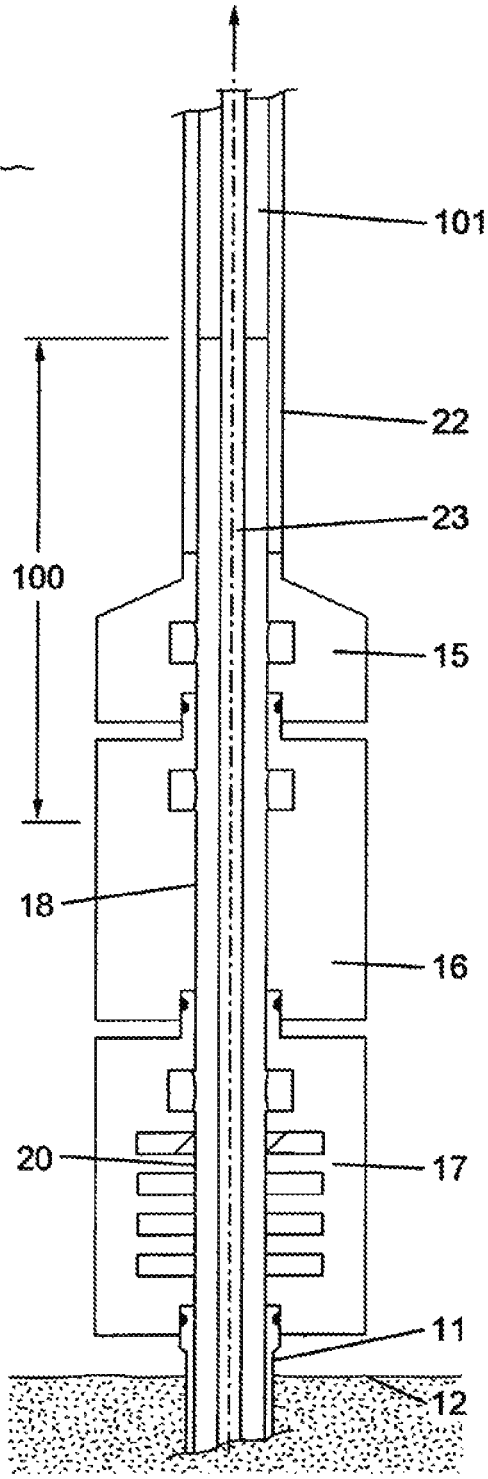

FIGS. 1*a* and *b* show a subsea drilling system 5 including a subsea BOP stack assembly 10 and a wellhead assembly 11. In particular, the wellhead assembly 11 is formed at the upper end of a bore into the seabed 12. The BOP stack assembly 10 is, in this example, includes a BOP lower marine riser package 15 (LMRP), a BOP separator 16, and a BOP ram package 17. The BOP separator 16 comprises a full bore spool 18. The full bore spool 18, the LMRP 15, and the BOP ram package 17 are connected in such a way that there is a continuous bore 20 from the lower end of the BOP stack through to the upper end of the LMRP 15. The lower end of the BOP stack 17 is connected to the upper end of the wellhead 11 and is sealed in place.

The system 5 is operating at a wellhead return mud pressure that is insufficient to allow the mud to flow to the surface vessel. The wellhead return mud pressure can be the hydrostatic mud pressure produced by drilling fluid in the riser pipe 22 along the distance 100 as the remaining part of the riser will contain atmospheric air 101. The upper part of the LMRP 15 is connected to the end of the riser pipe 22, which connects the BOP assembly 10 to a surface vessel shown in FIG. 1*a*.

Within the bore 20, a tubular string 23 is provided. Such a string may incorporate a number of different types of components, including simple piping, joint members, bore guidance equipment and may have attached at its lower end, a test tool, a drill bit or a simple device which allows the circulation or the flow of desired fluids through the well. Alternatively, the string may take the form of casing, tubing, coiled tubing, wire line or cables, or other components which is necessary to pass through the BOP separator and the BOP ram package into the wellhead 11.

Figure 2:
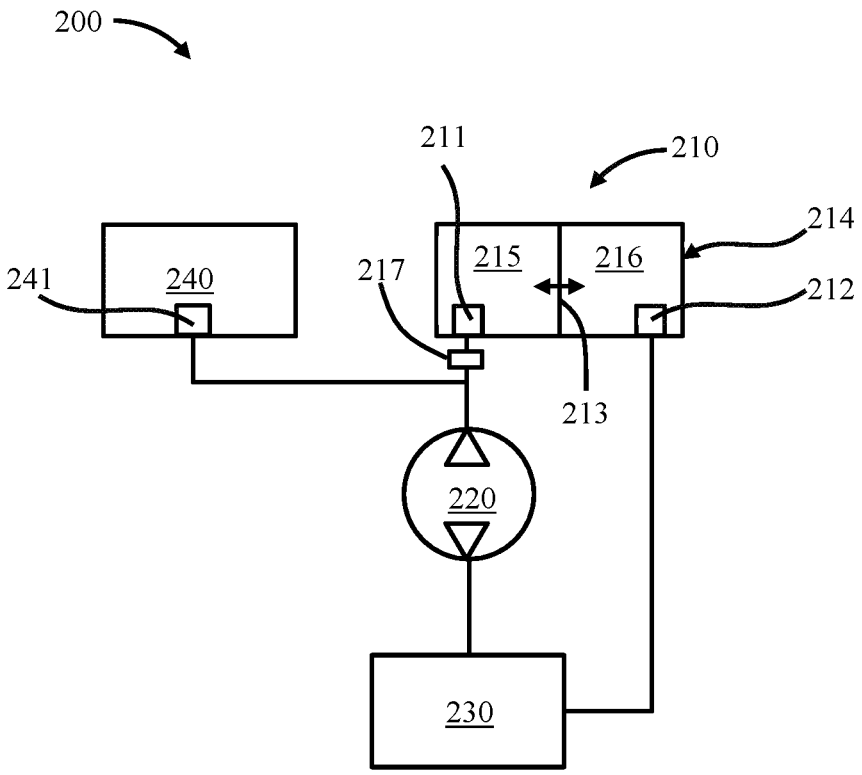
FIG. 2 depicts a schematic of a hydraulic system, according to one or more embodiments.

FIG. 2 depicts a hydraulic system 200 according to one or more embodiments. The hydraulic system 200 includes a pressure vessel 210, a power source 220 (e.g., a hydraulic pump), a fluid reservoir 230, and a hydraulic device 240 (e.g., a subsea well device such as a subsea BOP). As an example, the hydraulic system 200 may be deployed subsea to control the timing of the activation sequence of BOPs on a BOP stack assembly (10 of FIGS. 1*a* and *b*). In one or more embodiments, the device 240 can include the BOP ram package 17 on BOP stack assembly 10 located at the seabed. The various BOPs (annular BOPs or ram BOPs) on the BOP stack assembly 10 may be activated at different times with one control signal and the pressure vessel 210 can be used to delay the activation of a BOP on the BOP stack assembly 10. In one or more embodiments, the hydraulic system 200 may be used to control the hydraulic timing of other applications of the device 240, such as hydraulic timing in a surface well. Further, the hydraulic system 200 may be used to adjust the charged pressure of the pressure vessel 210. That is, the pressure vessel 210 may also serve as an adjustable volume hydraulic energy storage device, such as an adjustable accumulator.

The pressure vessel 210 can be hydraulically coupled to the power source 220 through a pressure port 211. The power source 220 can include a hydraulic pump that pumps hydraulic fluid from the reservoir 230 to the pressure vessel 210. In one or more embodiments, the power source 220 can include a piston under the hydrostatic pressure from seawater at the depth of the power source 220. The piston of the power source 220 divides a working fluid in communication with the pressure vessel 210 and the seawater. Further, the pressure vessel 210 can be hydraulically coupled to the reservoir 230 through a reset port 212. The pressure vessel 210 includes a piston 213 moveably received in the housing 214. The piston 213 divides the inside of the housing 214 into a pressure cavity 215 and a reset cavity 216. The pressure port 211 can be configured to allow hydraulic communication with the pressure cavity 215; and the reset port 212 can be configured to allow hydraulic communication with the reset cavity 216.

The power source 220 fills pressure cavity 215 with fluid from the reservoir 230. As the pressure cavity 215 is filled, the piston 213 strokes and presses fluid out of the reset cavity 216 through the reset port 212 into the reservoir 230 or alternatively out into the environment outside the system 200. The power source 220 continues to fill the pressure cavity 215 until the piston 213 is stroked and a predetermined pressure is reached within the pressure cavity 215 before operating the device 240. The amount of time it takes to fill the pressure cavity 215 with fluid enough to reach the predetermined pressure may be adjusted by adjusting the length of the stroke of the piston 213. In particular, the stroke of the piston 213 ultimately controls the volume of the pressure cavity 215 and thus controls a factor in selecting the amount of time it takes to reach the predetermined pressure. For example, the pressure vessel 210 may be designed so that the predetermined pressure may be reached within a predetermined amount of time, such as 45, 30, or 20 seconds. In one or more embodiments, the flow control valve 217 may be coupled between the power source 220 and the pressure port 211 to further adjust the amount of time it takes to charge the pressure cavity 215 to the predetermined pressure.

When the predetermined pressure is reached, a pilot circuit 241 (e.g., a control valve) is triggered, and device 240 is activated, which for example can be activating a shear ram on a BOP stack to seal a subsea wellbore. The pilot circuit 241 may include a control valve to hydraulically operate the device 240. Thus, when the pressure cavity 215 reaches the predetermined pressure, the device 240 can be operated with the fluid. To reset the pressure vessel 210, the fluid flow of power source 220 can be reversed Filling the reset cavity 216 with fluid moves the piston 213 to a starting position, pressing fluid from the pressure cavity 215 into the reservoir 230. Thus, the device 240 can be configured to operate when the pressure cavity 215 of the pressure vessel 210 reaches a predetermined pressure adjustable by the limits of travel of the piston 213 as will be described herein further.

In one or more embodiments, a bank of pressure vessels 210 may be used to increase the time delay in the hydraulic system 200. Two or more pressure vessels 210 may be hydraulically coupled in parallel with the power source 220 and the device 240 to increase the delay produced by the pressure vessels 210.

Figure 3:
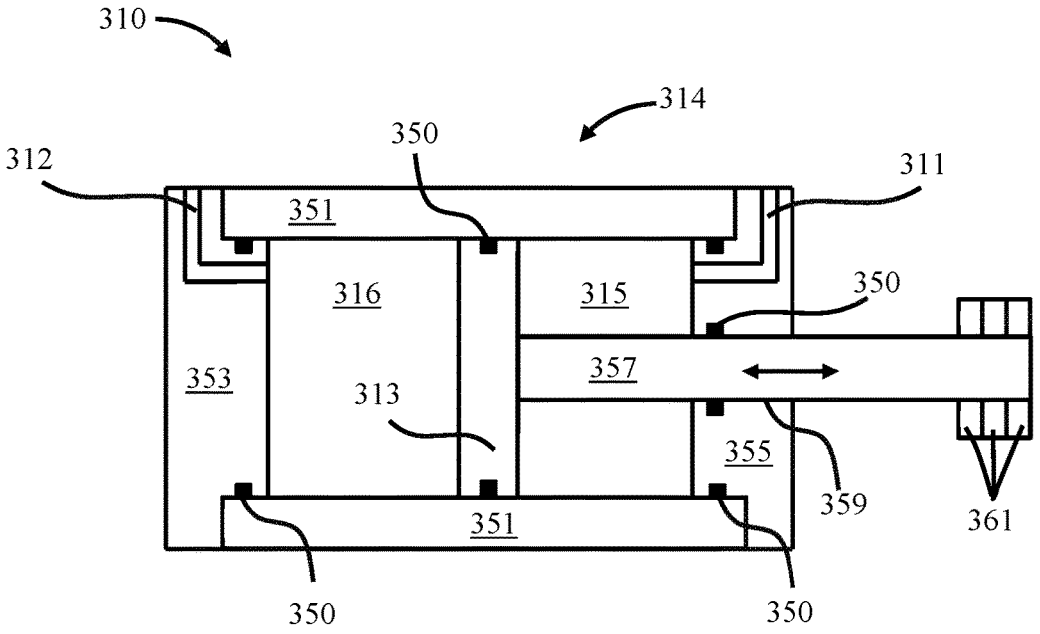
FIG. 3 depicts a cross-section of the adjustable volume pressure vessel in FIG. 2, according to one or more embodiments.

FIG. 3 depicts a cross-section of the pressure vessel 310, according to one or more embodiments. As shown, a piston 313 is moveably received in a housing 314, dividing the housing 314 into a pressure cavity 315 and a reset cavity 316, the volume of each adjust depending on the movement of the piston 313. Limits of travel of the piston 313 can be adjustable so as to limit the stroke of the piston 313 within the housing 314. Further, the piston 313 includes one or more seals 350 to isolate fluid communication between pressure cavity 315 and reset cavity 316. The seals 350 can include elastomer seals, O-ring seals, annular seals, or any other suitable sealing device. The housing 314 further includes a cylinder 351 and two flanged end caps 353, 355 sealably coupled to the cylinder 351 with one or more seals 350.

The pressure vessel 310 can be pressure balanced from the hydrostatic pressure outside of housing 315. In one or more embodiments, housing 314 may be pressure balanced by pre-charging the reset cavity 316 to a predetermined pressure that compensates for the hydrostatic pressure at the deployed depth of the pressure vessel 310. Further, the pressure cavity 315 may be charged to another predetermined pressure that compensates for the hydrostatic pressure outside the housing 315 and that is sufficient to operate the device 240 of FIG. 2.

A rod 357 can be coupled to the piston 313 and sealably received through the rod port 359 located on the end cap 355. The rod 357 can extend through the rod port 359 outside of the housing 314. One or more spacers 361 can be removably coupled to the rod 357 and configured to limit the stroke of the piston 313. The spacers 361 can be rigid and annular in shape to mate with the rod 357. In particular, the rod 357 can be threaded to receive the spacers 361, which can be likewise threaded. As the pressure cavity 315 is filled with fluid, the piston 313 moves toward the end cap 353. If the spacers 361 are attached to the rod 357, the stroke of the piston 313 stops when a spacer 361 contacts the end cap 355. Attaching or removing the spacers 361 can adjust the stroke of the piston 313, which in turn adjusts the maximum volume of the pressure cavity 315. Further, the spacers 361 can have varying widths to adjust the stroke of the piston 313 and can be attached anywhere along the rod 357. Optionally, the rod 357 can include no spacers 361 attached to it, allowing the piston 313 to fully extend within housing 314.

Figure 4:
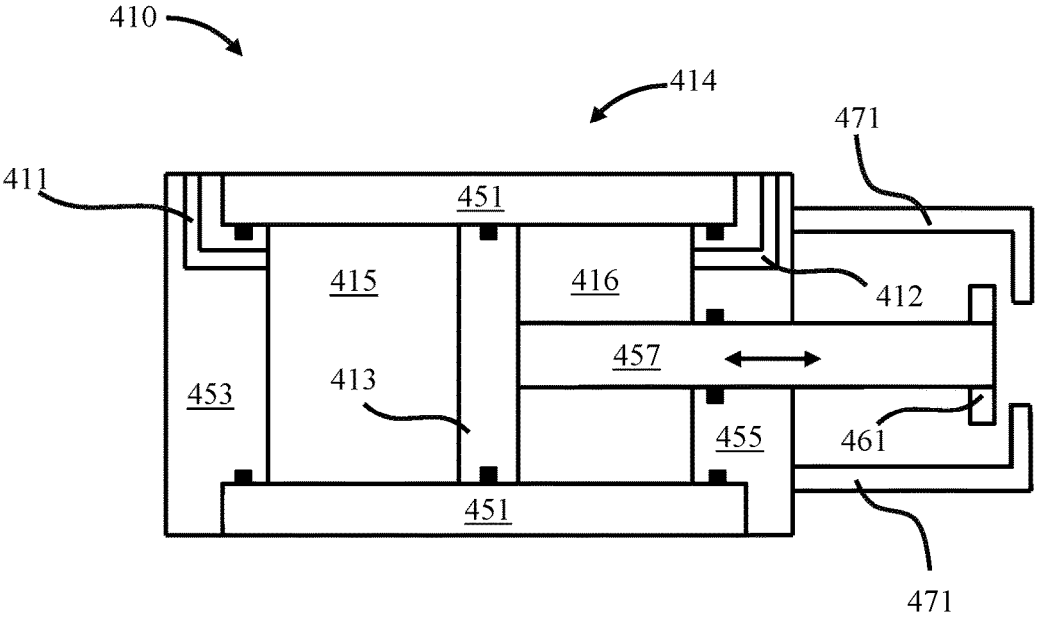
FIG. 4 depicts a cross-section of the adjustable volume pressure vessel in FIG. 2, according to one or more embodiments.

FIG. 4 depicts a cross-section of the pressure vessel 410, according to one or more embodiments. The pressure vessel 410 can include one or more brake wall(s) 471 that are configured to limit the stroke of the piston 413 as fluid fills pressure cavity 415. As illustrated the brake wall 471 is a rigid cylindrical structure. The rake wall 471 can include any rigid, stationary (relative to the piston 413 and rod 457) surface that limits the stroke of the piston 413 when a spacer 461 or the rod 457 contact the brake wall 471. Additionally, the brake wall 471 can be positioned to adjust the stroke of the piston 413, such as varying the height of the brake wall 471 or varying the distance of the brake wall 471 from the end cap 455. As the pressure cavity 415 is filled with fluid, the piston 413 moves toward the end cap 455. The stroke of piston 413 stops when the spacer 461 or the rod 457 contact the brake wall 471.

Optionally, one or more spacers 461 can be positioned on the rod 457 to limit the stroke of the piston 413 in the opposite direction. That is, as the reset cavity 416 is filled with fluid, the piston 413 moves toward the end cap 453 and a spacer 461 stops the stroke of piston 413 when the spacer 461 contacts the end cap 455. In one or more embodiments, the spacer 461 can be removably coupled to the rod 457 and configured to limit the stroke of the piston 413 in one direction changing the starting position of the piston 413 when the pressure vessel 410 is reset, while the brake wall 471 can be positioned to limit the stroke of the piston 413 in another direction. Further, the rod 457 can include no spacers 461 attached to it, allowing the piston 413 to fully extend within the housing 414. In one or more embodiments, the rod 457 can include no spacers 461, but the brake wall 471 can be positioned to limit the stroke of the piston 413 by contacting the rod 457. Thus, the stroke of the piston 413 can be adjusted by performing at least one of: selecting a spacer 461 to couple to the rod 457, selecting a spacer 461 to be removed from the rod 457, positioning a brake wall 471 to limit a stroke of the piston 413, and removing the brake wall 471 from limiting the stroke of the piston 413.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. An adjustable volume pressure vessel system, comprising:

a housing comprising:

a rod port therethough;

a reset port therethrough; and a pressure port therethrough;

a piston moveably received in the housing so as to divide the housing into a reset cavity and a pressure cavity, limits of travel of the piston being adjustable so as to limit a stroke of the piston within the housing;

a rod coupled to the piston and extending through the rod port outside of the housing;

a spacer threadably coupled about a portion of the rod positioned outside of the housing to limit the stroke of the piston;

a control valve that is actuated in response to attainment of a predetermined pressure within the pressure cavity; and a blowout preventer, wherein the reset port is configured to allow hydraulic communication with the reset cavity;

wherein the pressure port is configured to allow hydraulic communication with the pressure cavity; and wherein the control valve is configured to enable a flow of fluid to the blowout preventer to operate the blowout preventer when the control valve is actuated in response to attainment of the predetermined pressure within the pressure cavity.

2. The adjustable volume pressure vessel system of claim 1, further comprising a brake wall positioned to limit the stroke of the piston.

3. The adjustable volume pressure vessel system of claim 1, wherein the spacer comprises a threaded radially-inner surface that is configured to be threadably coupled to a corresponding threaded radially-outer surface of the portion of the rod to limit the stroke of the piston.

4. The adjustable volume pressure vessel system of claim 1, wherein the housing is pressure balanced from a hydrostatic pressure outside of the housing.

5. The adjustable volume pressure vessel system of claim 1, wherein the spacer is configured to limit the stroke of the piston in one direction; and the adjustable volume pressure vessel system further comprises a brake wall positioned to limit the stroke of the piston in another direction.

6. The adjustable volume pressure vessel system of claim 1, wherein the piston is sealably coupled to the housing to prevent fluid communication between the reset cavity and the pressure cavity, and the housing comprises a cylinder and two flanged end caps sealably coupled to the cylinder.

7. The adjustable volume pressure vessel system of claim 1, further comprising a power source configured to provide a fluid to the pressure cavity, and a flow control valve positioned along a fluid conduit between the power source and the pressure cavity.

8. A subsea drilling system, comprising:

an adjustable volume pressure vessel, comprising:

a housing comprising:

a rod port therethrough;

a reset port therethrough;

a pressure port therethrough a piston moveably received in the housing so as to divide the housing into a reset cavity and a pressure cavity, limits of travel of the piston being adjustable so as to limit a stroke of the piston within the housing;

a rod coupled to the piston and extending through the rod port outside of the housing;

wherein the reset port is configured to allow hydraulic communication with the reset cavity;

wherein the pressure port is configured to allow hydraulic communication with the pressure cavity; and a power source hydraulically coupled to the pressure port;

a reservoir hydraulically coupled to the reset port;

a subsea well device operated by and hydraulically coupled in parallel with the power source and the pressure port; and wherein the subsea well device is configured to operate when the pressure cavity of the pressure vessel reaches a predetermined pressure adjustable by the limits of travel of the piston.

9. The hydraulic system of claim 8, wherein the pressure vessel further comprises a spacer removably coupled to the rod and configured to limit the stroke of the piston.

10. The hydraulic system of claim 8, wherein the pressure vessel further comprises a brake wall positioned to limit the stroke of the piston.

11. The hydraulic system of claim 8, wherein the pressure vessel further comprises more than one spacer removably coupled to the rod and configured to limit the stroke of the piston.

12. The hydraulic system of claim 8, wherein the housing is pressure balanced from a hydrostatic pressure outside of the housing.

13. The hydraulic system of claim 8, wherein the housing further comprises:

a spacer removably coupled to the rod and configured to limit the stroke of the piston in one direction; and a brake wall positioned to limit the stroke of the piston in another direction.

14. A method of operating a device in a hydraulic system, comprising:

adjusting a stroke of a piston in a housing, wherein the piston divides the housing into a reset cavity and a pressure cavity;

filling the pressure cavity with a fluid to move the piston the length of its stroke and until the pressure cavity reaches a predetermined pressure; and operating the device with the fluid when the pressure cavity reaches the predetermined pressure;

wherein the device comprises a blowout preventer.

15. The method of claim 14, wherein the adjusting comprises at least one of: selecting a spacer to be coupled to the rod and positioning a brake wall to limit the stroke of the piston.

16. The method of claim 14, further comprising:

hydraulically coupling a power source to the pressure cavity; and hydraulically coupling a reservoir to the reset cavity.

17. The method of claim 14, further comprising filling the reset cavity with a fluid to reset the piston to a starting position.

* * * * *